US005690226A

United States Patent [19]

N'Guyen

[11] Patent Number: 5,690,226

[45] Date of Patent: Nov. 25, 1997

[54] AIR-IMPERMEABLE PACKAGING FOR MEDICAL IMPLANTS

[75] Inventor: Hugues N'Guyen, Breville les Monts, France

[73] Assignee: Benoist Girard, Hérouville-Saint-Clair, France

[21] Appl. No.: 634,993

[22] Filed: Apr. 19, 1996

[51] Int. Cl.[6] ..... B32B 31/20; B65D 1/34

[52] U.S. Cl. ..... 206/438; 206/484.2; 220/359; 156/69; 264/249

[58] Field of Search ..... 206/461, 438, 206/439, 484, 484.1, 484.2, 469–471; 220/359; 229/125.33, 125.35; 383/202; 264/248, 249, 268; 53/329.3, 478; 156/69, 537

[56] References Cited

U.S. PATENT DOCUMENTS

| | | | |
|---|---|---|---|
| 4,689,099 | 8/1987 | Ito et al. | 220/359 |
| 4,697,703 | 10/1987 | Will | 206/438 |
| 4,771,935 | 9/1988 | Hekal | 206/484.2 |
| 4,865,217 | 9/1989 | Yoshimoto | 220/359 |
| 4,948,441 | 8/1990 | Peck | 156/69 |
| 5,092,469 | 3/1992 | Takata et al. | 220/359 |
| 5,178,293 | 1/1993 | Suzuki et al. | 206/484 |
| 5,582,665 | 12/1996 | Eigen et al. | 156/69 |

*Primary Examiner*—Paul T. Sewell
*Assistant Examiner*—Luan K. Bui
*Attorney, Agent, or Firm*—Peter C. Richardson; Lawrence C. Akers; Raymond W. Augustin

[57] ABSTRACT

A sealed airtight container and a method for forming the same produces an increased resistance between the seal and a flange on the container to pressure differences between the inside of the container and the outside environment. The container includes a body having a hollow interior with sidewalls, a bottom, and having a planar opening at one end. The opening in the hollow interior is surrounded by an outwardly extending flange. A multi-layer peelable cover is sealed to the flange surrounding the opening. The cover and the flange are deformed towards the bottom of the container from the plane of the opening to be sealed.

12 Claims, 5 Drawing Sheets

AIR-IMPERMEABLE PACKAGING FOR MEDICAL IMPLANTS

BACKGROUND OF THE INVENTION

1. Field of the Invention

This invention relates to the field of air-impermeable packaging for polymeric medical implants sealed in containers with peelable covers. More particularly, this invention relates to a controlled atmosphere packaging design with superior resistance to negative (vacuum) pressure while maintaining good peelability.

2. Description of the Prior Art

Controlled atmosphere packaging (CAP) has been commonly used to preserve the quality of products such as food, medicines, and medical devices during storage or shipping. Nitrogen, oxygen, moisturized air, and vacuum are examples of controlled atmospheres used in such packaging. To preserve the gas composition or vacuum in the package for a long period of time, gas-impermeable (air tight) films or containers are used to seal or wrap the product. Polyethylene terephthalate (PET), poly(ethylene vinyl alcohol), poly (acrylonitrile), glass-coated plastic, and aluminum foil are examples of material with a reduced gas permeability.

In general, a product is placed in a gas-impermeable plastic container under controlled atmospheric conditions and then is sealed in the container with a peelable aluminum foil lid. Since the sealed package is air tight if the controlled atmosphere is at standard pressure, any negative pressure (or vacuum) outside the package will cause the expansion of the package and potentially seal failure. Negative pressure or vacuum conditions may occur when the package is shipped by an aircraft with insufficient pressurization, or when the package is sealed at a ground level and brought to a mountain or higher level where the atmospheric pressure is reduced.

Alternately, the package could be sealed under vacuum conditions and then stored under standard atmospheric conditions. In either case, a strong seal strength is needed to ensure the integrity of the package for these applications. For medical devices, seal failure can cause the loss of sterility. However, too strong a seal can compromise the peelability of the foil and/or plastic seal. It is very difficult to find a range of sealing strength that can meet these two conflicting requirements (pressure resistance and ease of opening). Many packages currently available in the market either require excessive forces to peel open or require cutting implements to open, which can damage the contents.

U.S. Pat. No. 4,875,587 relates to an easily peelable package having two multi-layer webs to seal a food product. Each multi-layer material has a self-welding sealant layer on one of its surfaces which adhere to each other around the article. The sealant layers are further sealed to each other in a heat fusion seal around the article to enclose the article. The bond between the sealant layer and its adjacent layer in the second web is weaker in the fusion seal area than between the two sealant layers. Thus, when the self-welded portions are peeled apart and the peeling action reaches the fusion seal area the sealant layer of the second web tears out to access the article.

SUMMARY OF THE INVENTION

It is an object of the present invention to provide a method for producing a package with a moderate seal strength for ease of opening but with a superior resistance to a negative pressure.

It is a further object of the invention to provide a simple design change to the container shape which may be performed during the heat sealing operation which provides a significantly increased resistance to pressure differentiations between the interior and exterior of the sealed container.

These objects are accomplished by a container formed from a body having a hollow interior with side walls, a bottom, and having a planar opening at one end. The opening in the hollow interior is surrounded by an outwardly extending flange. A multi-layer peelable cover is sealed to the flange surrounding the opening. The cover and the flange are deformed to extend at an angle with respect to the plane of the opening. Usually, the deformation of the flange is towards the bottom of the container.

The angle of the deformed flange with respect to the plane of the opening is anywhere between 20° and 80° and preferably 60°.

The benefit of the present invention may be seen by the failure mechanism of prior art containers during pressure testing. As the outside pressure is reduced, the nitrogen gas in the container expands, producing a separation force between the multi-layer foil cover and the container flange bonded by the sealant layer in the multi-layer aluminum foil cover. The separation force can be resolved into two vector components: the force vertical to and the force parallel to the flange plane at the separation point. In principle, only the vertical force component causes the separation and failure of the seal, while the parallel force component exerts only a pulling action and contributes little to the seal deformation. The bent flange of the present invention decreases the vertical force component at the bending point during nitrogen gas expansion so that the effective seal strength is greatly enhanced. The bending design, however, does not affect the peelability of the cover because it does not change the intrinsic bonding strength.

These and other objects and advantages of the present invention will become apparent from the following description of the accompanying drawings, which disclose several embodiments of the invention. It is to be understood that the drawings are to be used for the purposes of illustration only and not as a definition of the invention.

BRIEF DESCRIPTION OF THE DRAWINGS

In the drawings, wherein similar reference characters denote similar elements throughout the several views.

DESCRIPTION OF THE PREFERRED EMBODIMENT

Referring to FIGS. 1–5 there is shown the container or blister package 20 and the process for manufacturing the heat sealed container of the present invention. This process may be done with conventional machines such as the 350 Galaxy Multivac Seal Machine by Multivac Packaging Machines, Inc. of Kansas City, Mo.

Figure 1:
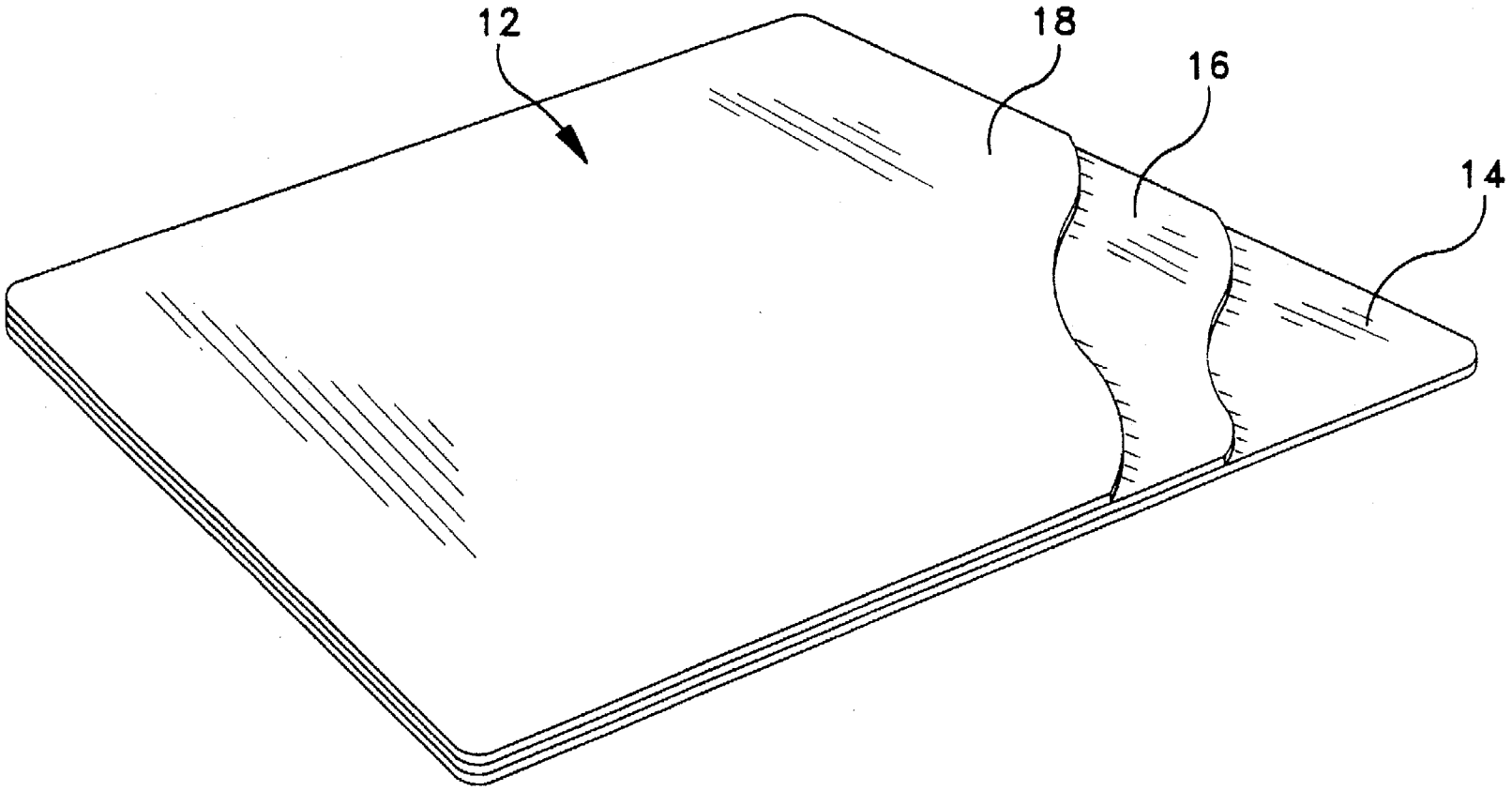
FIG. 1 is a view of the foil lid for sealing the container of the present invention.

Referring to FIG. 1, cover 12 includes a sealant layer 14 and a protective layer 18 containing a foil layer 16 therebetween. Sealant layer 14 is easily meltable and bonds the cover 12 to a flange 22 on the underlying container 20. Cover 12 is commercially available from the Rollprint Packaging Products, Inc. of Addison, Ill. as the layer of aluminum foil lid 1010B.

Figure 2:
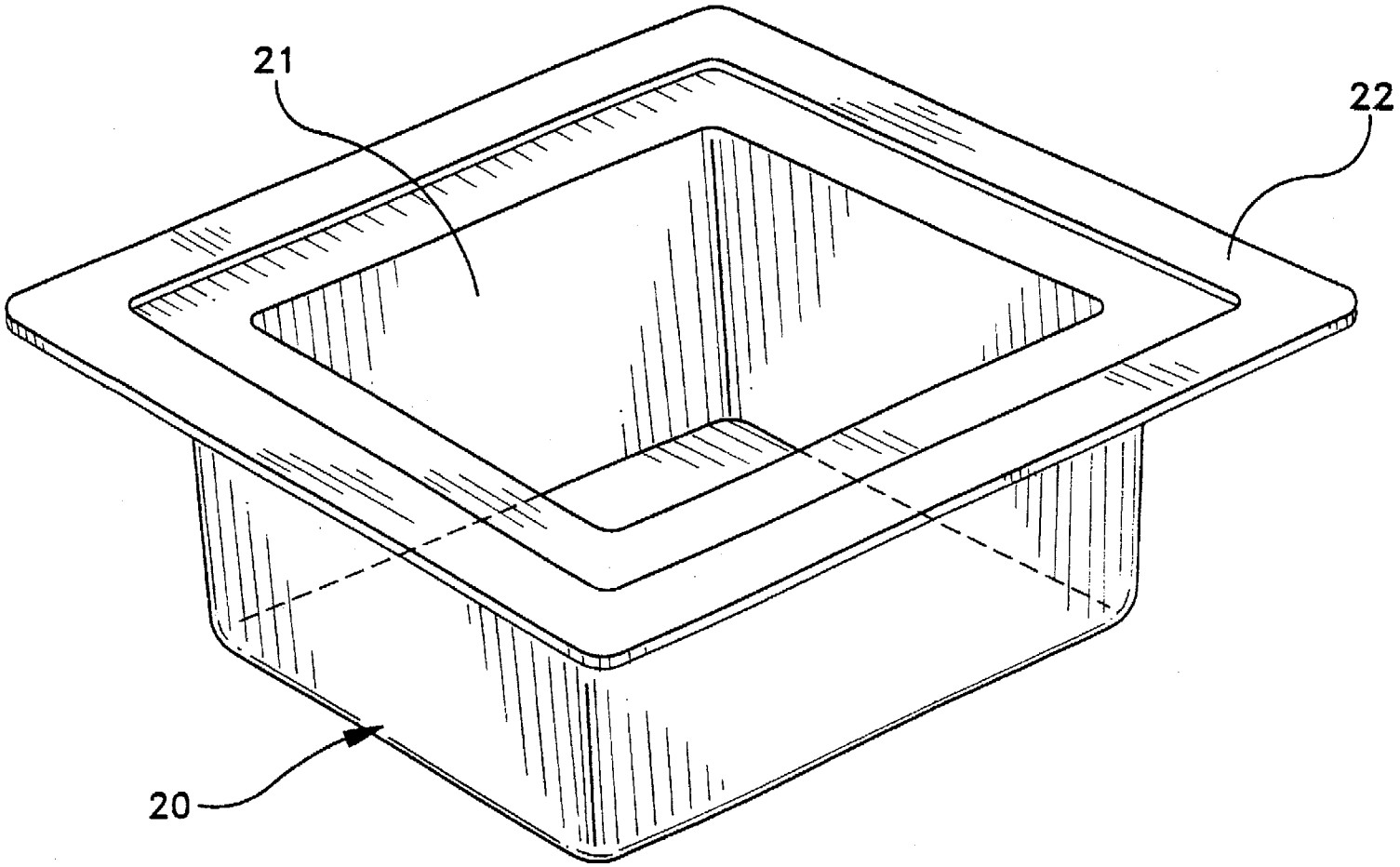
FIG. 2 is an isometric view of the container of the present invention.
Figure 3:
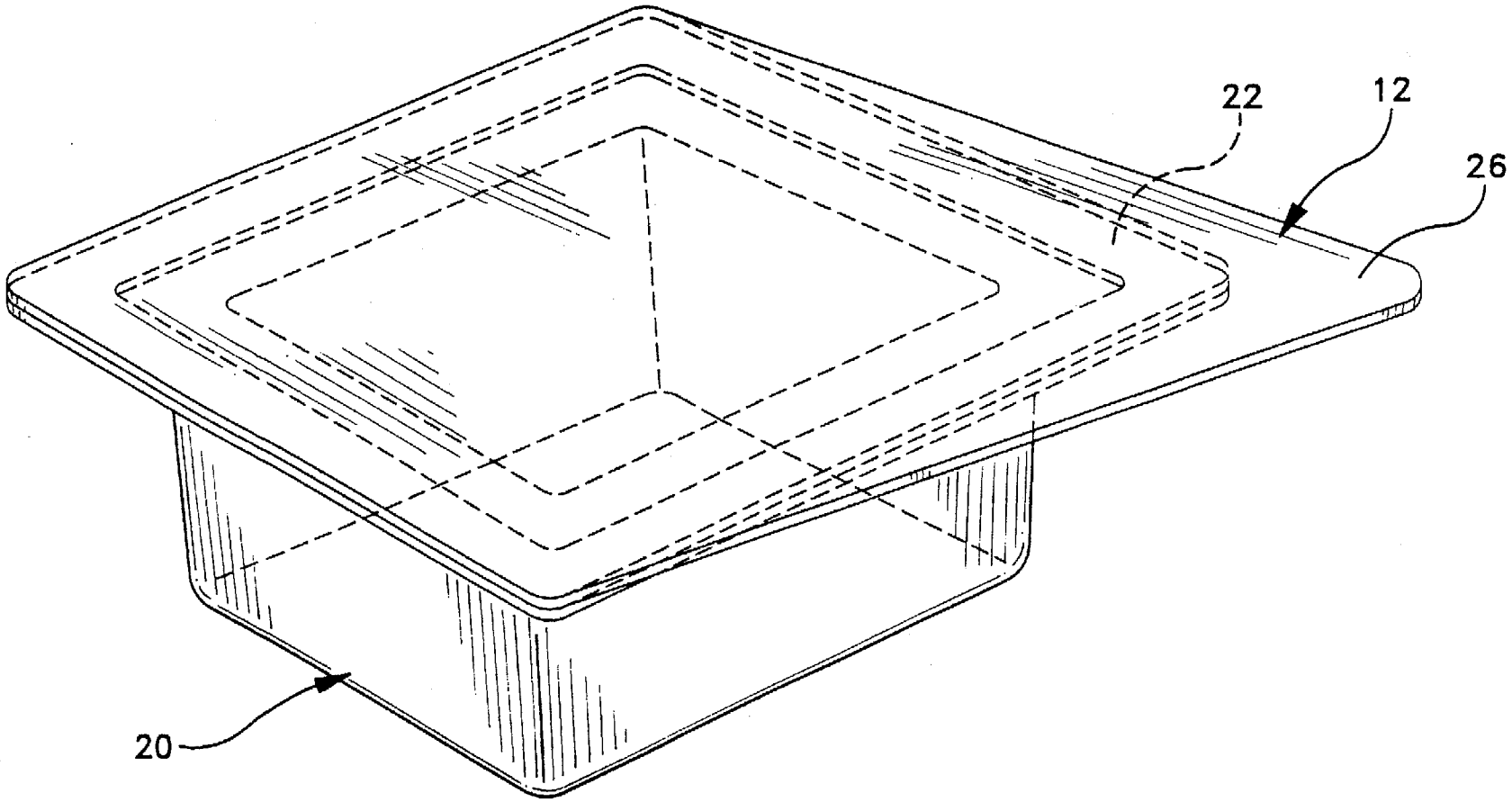
FIG. 3 is an isometric view of the container of the present invention after it has been sealed with the foil cover of FIG. 1.

Referring to FIG. 2, there is the container 20 of the present invention which may be of any size and shape and may be in the form of a "blister" made of a readily available material PETG (a copolyester made by Eastman Chemical). This is a common package molded from the PETG plastic. Container 20 has a planar opening 21 at one end thereof. This container may be used to house a wide variety of products such as medical devices. For example, once the medical device is placed within container 20, the air is evacuated and then the interior of container 20 including the device is nitrogen flushed. Next the cover 12 is heat sealed on flange 22 of container 20, forming an air tight seal. The above process is the standard process utilized by a wide variety of packaging systems. The end result of this conventional packaging is shown in FIG. 3.

Figure 4:
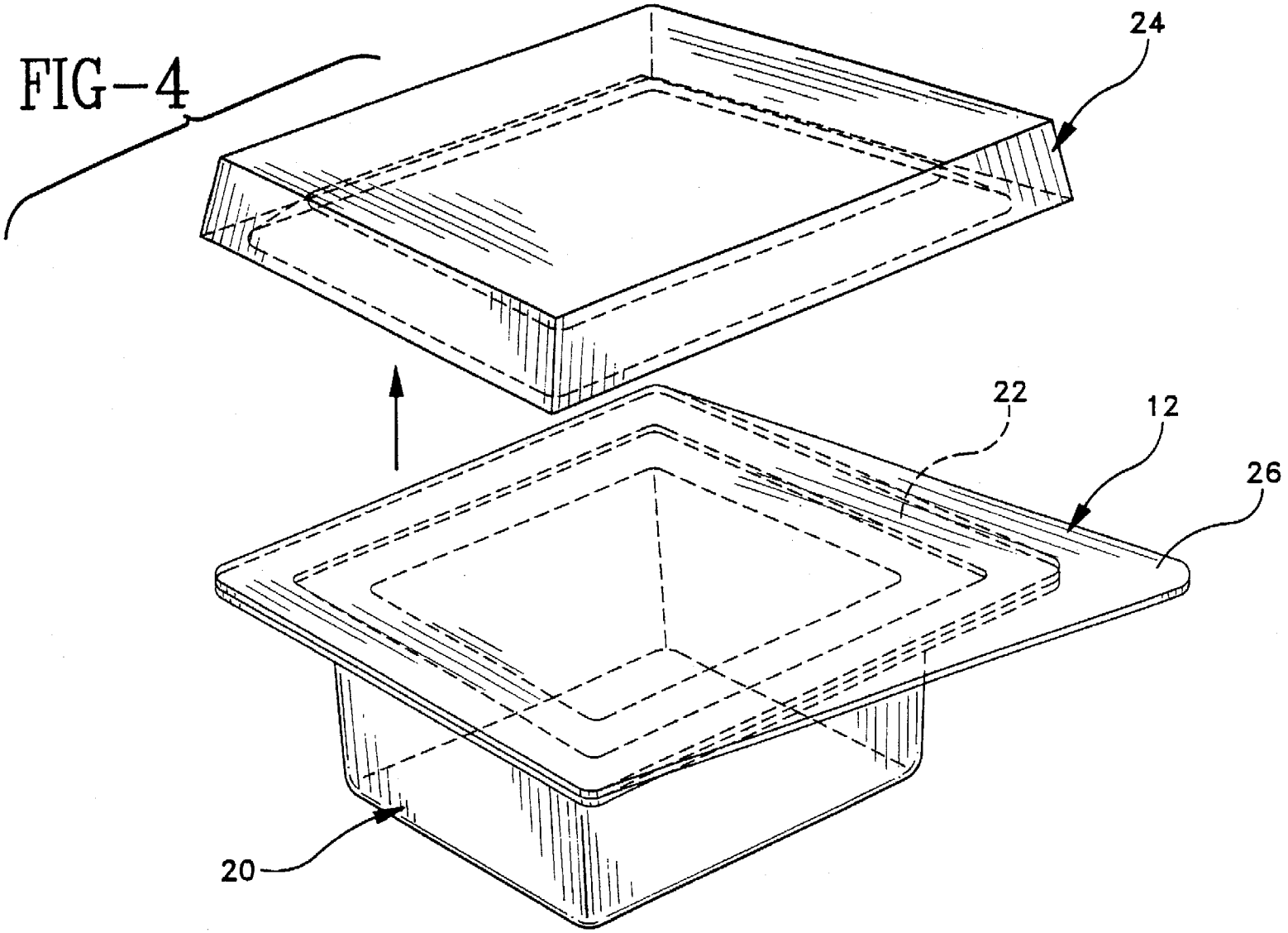
FIG. 4 shows the die operation in which the flange of the container of FIG. 3 is downwardly deformed.
Figure 5:
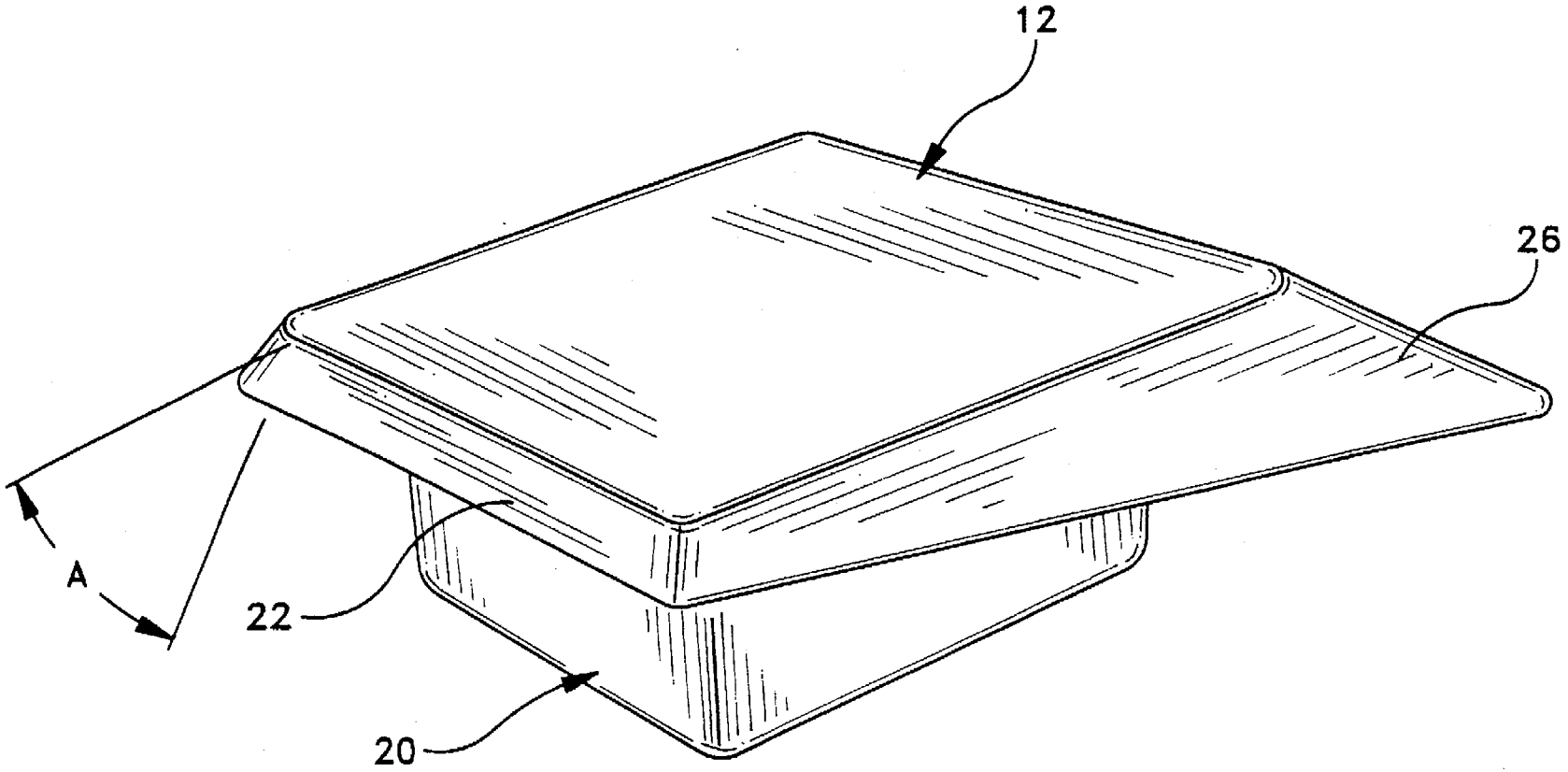
FIG. 5 is an isometric view of the sealed container.

Referring to FIG. 4, there is shown a die operation in which container 20 is moved towards a fixed die 24 which is shaped to surround the flange 22 of container 20. Die 24 has an internal shape angled at an angle A with respect to the plane of surface 30 which is the flat inner surface of the die corresponding to the plane of cover 12 on container 20.

Die 24 contacts flange 22 while it is still in the heated state, and therefor deformable. Die 24 is maintained in position engaged in flange 22 until the flange sufficiently cools so that upon removal of the die, the flange forms angle A with respect to the plane of cover 12. In the preferred embodiment angle A is about 60° with respect to the plane of the cover 12.

The preferred aluminum foil cover 12 contains a sealant layer made of polyethylene with an adhesive coating on the sealing side and a protective layer made of polyethylene on the outer side with the aluminum layer in between the two layers. After the article or device (not shown) is placed in the plastic container, the container is sealed by the gas flush heat sealing machine.

As stated above, in the preferred embodiment the sealing cycle starts with flushing and filling of nitrogen, heat seal the cover to the container flange, and then cutting/removing of any excessive material in the preferred aluminum foil cover 12. The nitrogen pressure in the package is set at one atmosphere (i.e., 14.7 psi) and the oxygen concentration in the package is less than 0.5% (as compared to 20.6% in air). Note that a rectangular container is shown in FIG. 2 that has a flat flange around the entire container where the heat seal takes place with the aluminum foil lid. At corner 26 there is left an excess (overhang) of the aluminum foil cover to be held and pulled to peel open the container.

It can be seen that the difference between the conventional packaging design and the design of the current invention is that for the invention, the flange is bent all-around and downward relative to the horizontal plane at about 20° to 80°. This is accomplished by a post-sealing operation that utilizes the residual heat from the heat seal step and a die to mechanically bend the flange downward while the PETG material is still soft. The bending can be achieved at the same time as sealing, if a bent seal head is used. The bending of the container flange can also be achieved by a separate heating source and a separate mechanical setup after the container is heat sealed and cooled. When subject to a negative pressure test, the invention can maintain the seal integrity up to a higher vacuum level than the conventional flat flange design.

EXAMPLE 1

Rectangular PETG (copolyester made by Eastman Chemical) blister packages having an open top were heat sealed in a nitrogen atmosphere with a multi-layer aluminum foil lid (Rollprint 1010B) on a packaging seal machine (350 Galaxy Multivac Seal Machine). The heat seal sequence included: (1) vacuum (2) nitrogen flush and filling (3) heat seal at 150° C. for 6 seconds, and (4) cutting of excessive aluminum foil. The nitrogen pressure in the package after sealing was approximately at the 14.7 psi (the atmospheric pressure). The blister packages were divided into four groups with different sealing conditions as shown in Table 1:

TABLE 1

| Group ID | Sealing Conditions |
|---|---|
| I | empty blister, flat flange |
| II | empty blister, 30° bent flange |
| III | empty blister, 60° bent flange |
| IV | a UHMWPE cup component placed in the blister, 60° bent flange |

The bending procedure was carried out using a simple bending setup shown in FIG. 4. After the heat seal and before the PETG material was cooled (i.e. within about 10 seconds after heat sealing), the sealed blister package was mechanically pushed up against the die 24 which was fixed in place. These four groups of sealed blister packages were tested for:

(1) oxygen concentration below 0.5%, using an oxygen analyzer, (2) vacuum pressure resistance, using a vacuum oven (Fisher Scientific ). For the vacuum pressure resistance test, the blister package was first placed in the vacuum oven at room temperature. The vacuum oven pressure was then gradually reduced (0.03 psi per minute) from 14.7 psi until the seal of the blister package failed. The vacuum oven pressure at the failure point and the corresponding altitude was recorded.

(3) hand peel test, using bare hands to peel the blister package open and report the acceptability using the not bent flanged container as a benchmark.

All the three tests were carried out at room temperature of 23° C. The results are shown below in Tables 2 through 4:

TABLE 2

Oxygen Concentrations

| Group ID | No. of Blisters tested | Average Oxygen Concentration, % |
|---|---|---|
| I | 15 | 0.235 ± 0.020 |
| II | 7 | 0.232 ± 0.017 |
| III | 20 | 0.225 ± 0.045 |
| IV | 20 | 0.230 ± 0.023 |

TABLE 3

Negative Pressure Resistance

| Group ID | No. of Blisters Tested | Average Vacuum Oven Pressure at Failure Point, psi | Corresponding Altitude at Failure Point, feet |
|---|---|---|---|
| I | 15 | 9.35 ± 0.29 | 12,000 |
| II | 7 | 7.84 ± 0.18 | 16,400 |

TABLE 3-continued

| Negative Pressure Resistance | | | |
|---|---|---|---|
| Group ID | No. of Blisters Tested | Average Vacuum Oven Pressure at Failure Point, psi | Corresponding Altitude at Failure Point, feet |
| III | 20 | 5.34 ± 0.5 | 25,500 |
| IV | 20 | 5.56 ± 0.5 | 25,000 |

TABLE 4

| Hand Peel Test | | |
|---|---|---|
| Group ID | No. of Blisters Tested | Peelability |
| I | 5 | Acceptable |
| II | 5 | Acceptable |
| III | 5 | Acceptable |
| IV | 5 | Acceptable |

From the above results, whether the flange was flat or bent at different angles, the oxygen concentration in all the blister containers was satisfactory i.e., less than the required 0.5%. On the other hand, the vacuum pressure resistance of the seal increased from 9.35 psi (corresponding to 12,000 feet altitude) for the flat flange to 7.84 psi (16,400 feet) for the 30° bent flange and further increased to 5.34 psi (25,500 feet) for the 60° bent flange. By comparison between Group III and Group IV results, there was almost no difference (within one standard deviation) in vacuum pressure resistance between the empty blister package and the blister package with an ultra high molecular weight polyethylene (UHMWPE) implant component.

The benefit of the bending design in the invention (Groups II, III, and IV) over the conventional design (Group I) was clearly demonstrated for the negative (vacuum) pressure resistance. All the blister containers passed the peelability test, i.e., the covers 12 on the containers with bent flanges peeled just as easily as those on the flat flanged covers.

Bending the flange at angles between 20° and 80° greatly increases the strength of the seal while not affecting the ease of peeling open the sealed package.

While several examples of the present invention have been described, it is obvious that many changes and modifications may be made thereunto, without departing from the spirit and scope of the invention.

I claim:

1. A method for forming a sealed airtight box-like hollow container having an opening extending in a plane at a top thereof, sidewalls, a bottom and having a peelable cover over said top planar opening, said container having increased resistance between the container and the outside environment comprising the steps of:

forming a container having an outwardly extending flange around the top planar opening of the container and parallel thereto;

heat sealing a multi-layer peelable cover to said flange; and deforming said sealed cover and said flange at an angle toward said bottom with respect to said plane of said top planar opening.

2. The method as set forth in claim 1 wherein said flange is deformed at an angle towards an end of said container opposite said opening.

3. The method as set forth in claim 2 wherein said angle is between 20° and 80° with respect to said plane of said opening.

4. The method as set forth in claim 3 wherein said angle is 60°.

5. A container comprising:

a plastic body having a hollow interior with sidewalls, a bottom, and having a planar opening extending in a plane at a top thereof, said plank opening at said top surrounded by an outwardly extending flange and a multi-layer peelable cover sealed to said flange surrounding said top planar opening, said cover and said flange after deformation extending permanently at an angle towards said bottom with respect to said plane of said planar opening.

6. The container as set forth in claim 5 wherein said flange is deformed at an angle towards said bottom of said container.

7. The container as set forth in claim 6 wherein said angle is between 20° and 80° with respect to said plane of said flange.

8. The container as set forth in claim 7 wherein said angle is 60°.

9. A method for forming a sealed airtight box-like hollow container having an opening extending in a plane at a top thereof sidewalls, a bottom and having a peelable cover over said top planar opening, said container having increased resistance between the inside of the container and the outside environment comprising the steps of:

forming a container having a flange extending around the top planar opening and parallel thereto; and simultaneously heat sealing a multi-layer peelable cover to said flange and deforming said cover and said flange at an angle toward said bottom with respect to said plane of said top planar opening.

10. The method as set forth in claim 9 wherein said flange is deformed at an angle towards said bottom of said container.

11. The method as set forth in claim 10 wherein said angle is between 20° and 80° with respect to said plane of said flange.

12. The method as set forth in claim 11 wherein said angle is 60°.

* * * * *